US010526892B2

(12) United States Patent
Bini et al.

(10) Patent No.: US 10,526,892 B2
(45) Date of Patent: Jan. 7, 2020

(54) MULTISTAGE TURBINE PREFERABLY FOR ORGANIC RANKINE CYCLE ORC PLANTS

(71) Applicant: TURBODEN SPA, Brescia (IT)

(72) Inventors: Roberto Bini, Brescia (IT); Mario Gaia, Brescia (IT); Davide Colombo, Brescia (IT)

(73) Assignee: TURBODEN SPA, Brescia (BS) (IT)

( * ) Notice: Subject to any disclaimer, the term of this patent is extended or adjusted under 35 U.S.C. 154(b) by 141 days.

(21) Appl. No.: 15/562,378

(22) PCT Filed: Mar. 21, 2016

(86) PCT No.: PCT/IB2016/051581

§ 371 (c)(1),
(2) Date: Sep. 27, 2017

(87) PCT Pub. No.: WO2016/157020

PCT Pub. Date: Oct. 6, 2016

(65) Prior Publication Data

US 2018/0283177 A1 Oct. 4, 2018

(30) Foreign Application Priority Data

Apr. 3, 2015 (IT) ..... 102015902342533

(51) Int. Cl.
*F01D 5/06* (2006.01)
*F01D 25/24* (2006.01)
(Continued)

(52) U.S. Cl.
CPC ..... *F01D 5/066* (2013.01); *F01D 25/243* (2013.01); *F01K 23/10* (2013.01); *F01K 25/10* (2013.01);
(Continued)

(58) Field of Classification Search
CPC . F01D 5/066; F01D 5/043; F01D 5/06; F01D 25/243; F01D 5/02; F01D 17/141; F01K 23/10; F01K 25/10
(Continued)

(56) References Cited

U.S. PATENT DOCUMENTS 1,896,809 A * 2/1933 Bentley ..... F01D 1/026 415/187
2,020,793 A * 11/1935 Meininghaus ..... F01D 5/041 415/84
(Continued)

FOREIGN PATENT DOCUMENTS

CN 101963073 A 2/2011
GB 310037 A 2/1930

OTHER PUBLICATIONS

Office Action issued in corresponding Chinese Patent Application No. 201680016506.9 dated Mar. 25, 2019, consisting of 13 pp. (English Translation Provided).

*Primary Examiner* — Nathaniel E Wiehe
*Assistant Examiner* — Latoia L Sudler
(74) *Attorney, Agent, or Firm* — Volpe and Koenig, P.C.

(57) ABSTRACT

A turbine of an organic Ranking cycle (ORC) is described. The turbine includes a shaft supported by at least two bearings and a plurality of axial stages of expansion, defined by arrays of stator blades alternated with arrays or rotor blades. The rotor blades are sustained by corresponding supporting disks. A main supporting disk is directly coupled to the shaft in an outer position with respect to the bearings, and the remaining supporting disks are constrained to the main supporting disk, and one to the other in succession, but not directly to the shaft. Some of the remaining supporting disks are constrained to the main supporting disk and cantileverly extend from the same side of the bearings that
(Continued)

support the shaft, so that the center of gravity of the rotor part of the turbine is shifted more towards the bearings.

21 Claims, 12 Drawing Sheets

(51) Int. Cl.
*F01K 23/10* (2006.01)
*F01K 25/10* (2006.01)

(52) U.S. Cl.
CPC ..... *F05D 2210/43* (2013.01); *F05D 2240/20* (2013.01); *F05D 2250/51* (2013.01)

(58) Field of Classification Search
USPC ..... 416/198 A
See application file for complete search history.

(56) References Cited

U.S. PATENT DOCUMENTS 2,081,150 A * 5/1937 Meininghaus ..... F01D 1/06 416/182
2,102,637 A * 12/1937 Meininghaus ..... F01D 1/06 415/84
2,115,031 A * 4/1938 Meininghaus ..... F01D 1/06 416/174
2,145,886 A 2/1939 Ulrich
2,430,183 A 11/1947 Jacob
2,614,799 A * 10/1952 Judson ..... F01D 5/06 416/198 R
2,747,367 A 5/1956 Savin
2,847,186 A * 8/1958 Anderson ..... F01D 9/04 415/17
2,918,252 A * 12/1959 Haworth ..... F01D 5/021 416/97 R
3,051,437 A * 8/1962 Morley ..... F01D 5/066 416/198 R
3,226,085 A * 12/1965 Bachl ..... F01D 1/06 415/199.3
3,586,459 A * 6/1971 Zerlauth ..... F01D 5/06 415/60
4,435,121 A * 3/1984 Wosika ..... F01D 1/34 415/198.1
4,655,251 A * 4/1987 Nimberger ..... F16K 1/14 137/516.25
5,810,041 A * 9/1998 Garofalo ..... B63C 11/2209 137/505.37
6,082,959 A * 7/2000 Van Duyn ..... F01D 21/045 415/173.4
7,670,109 B2 * 3/2010 Greim ..... F01D 1/04 29/889.2
9,383,030 B2 * 7/2016 Wu ..... F16K 31/1228
9,624,835 B2 * 4/2017 Carpenter ..... F01D 17/141
10,180,106 B2 * 1/2019 Ribarov ..... F02C 7/22
10,227,898 B2 * 3/2019 Kawashima ..... F01D 17/18
2009/0155062 A1 * 6/2009 Guimbard ..... F01D 5/141 415/194
2014/0363268 A1 * 12/2014 Gaia ..... F01D 1/04 415/1
2018/0016928 A1 * 1/2018 Kuwamura ..... F16J 15/4472

* cited by examiner

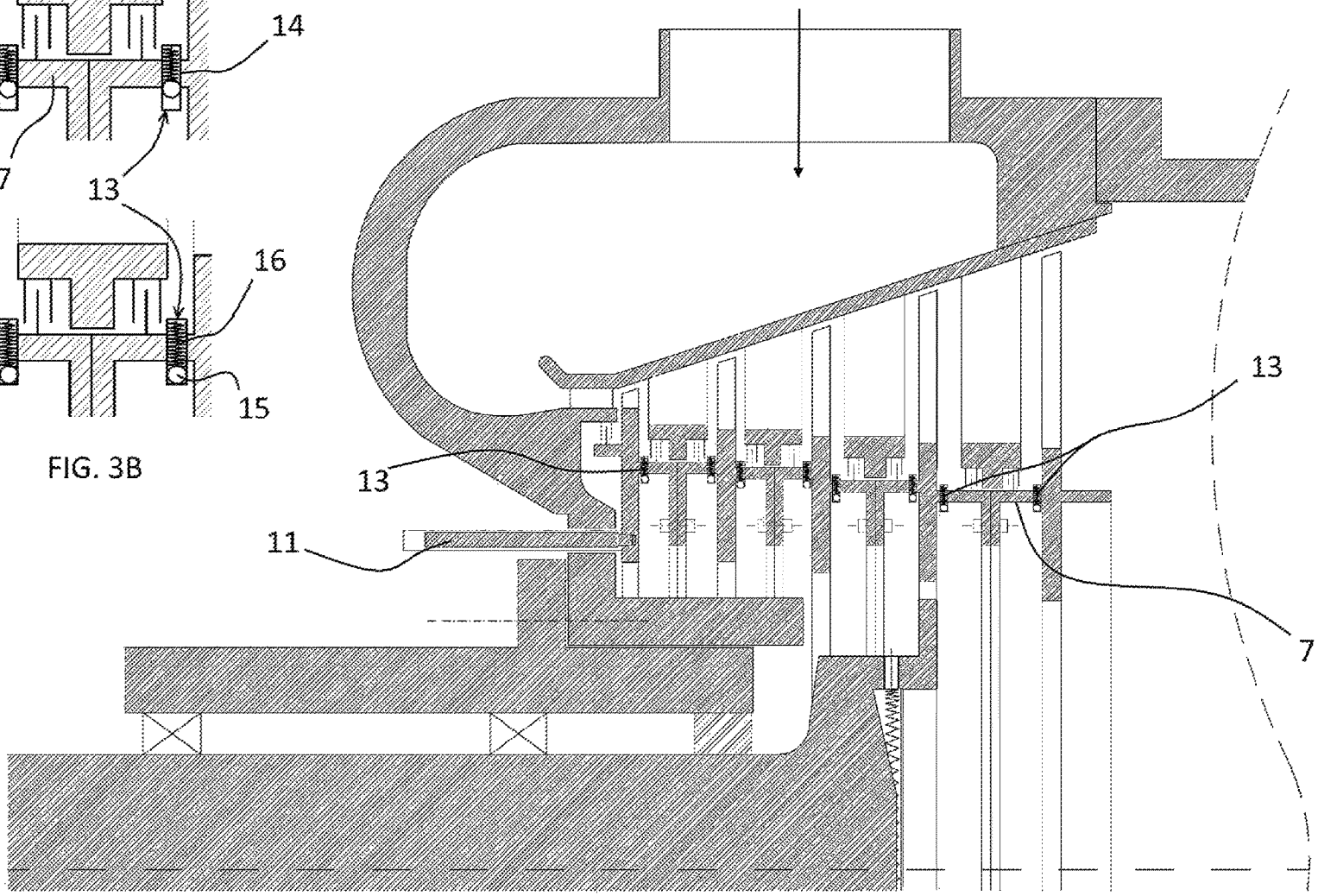
FIG. 3
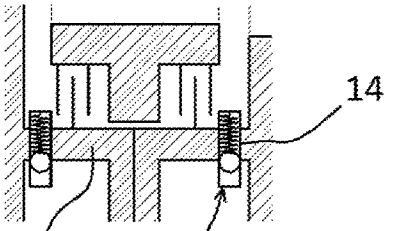
FIG. 3A
FIG. 3B

MULTISTAGE TURBINE PREFERABLY FOR ORGANIC RANKINE CYCLE ORC PLANTS

FIELD OF THE INVENTION

The present invention refers to a turbine designed for operating preferably in an Organic Rankine Cycle (ORC) or Kalina cycles or water vapor cycles.

STATE OF THE ART

The acronym ORC "Organic Rankine Cycle" usually indicates thermodynamic cycles of the Rankine type that use an organic working fluid, typically having a molecular mass higher than the water vapor, the latter being used by the vast majority of the Rankine power cycles.

ORC plants are often used for the combined production of electric and thermal power from solid biomass; other applications include the exploitation of waste heats of industrial processes, recovery heat from prime movers or geothermal or solar heat sources.

For example an ORC plant fed with biomass usually comprises:

- a combustion chamber fed with fuel biomass;
- a heat exchanger provided to transfer part of the heat of combustion fumes/gases to a heat-transfer fluid, such as a diathermic oil, delivered by an intermediate circuit;
- one or more heat-exchangers arranged to transfer part of the heat of the intermediate heat-transfer fluid to the working fluid thereby causing the preheating and evaporation thereof;
- a turbine powered by the working fluid in the vapor state; and
- an electric generator driven by the turbine for producing electric power.

In the heat exchanger downstream of the combustion chamber, the heat transfer fluid, for example diathermic oil, is heated up to a temperature usually of about 300° C. The heat-transfer fluid circulates in a closed-loop circuit, flowing through the above mentioned heat-exchanger where the organic working fluid evaporates. The organic fluid vapor expands into the turbine thereby producing mechanic power which is then converted into electric power through the generator connected to the shaft of the turbine itself. As the working fluid vapor terminates its expansion in the turbine, it is condensed in a specific condenser by transferring heat to a cooling fluid, usually water, used downstream of the plant as a thermal vector at about 80° C.-90° C., for example for district heating. The condensed working fluid is fed into the heat-exchanger in which the heat-transfer fluid flows, thereby completing the closed-loop circuit cycle. Often, there is also a regenerator cooling the vapor at the turbine output (before the condenser input) and pre-heating the organic liquid upstream of the pre-heater/evaporator.

The produced electric power can be used to operate auxiliary devices of the plant and/or can be introduced into a power distribution network.

In the ORC plants characterized by a high expansion ratio and a high enthalpy jump of the working fluid in turbine, the latter should be advantageously provided with three or more stages, where "stage" means an array of stator blades together with the respective array of rotor blades.

As the number of the turbine stages increases, so do the costs and project engineering and assembling become more and more complicated, until a limit in which two turbines connected in series may be advantageously used to operate a single generator. Therefore, instead of increasing the number of stages of a single turbine, for example up to six stages or more, two turbines, both with three stages, can be adopted.

For example, in a plant designed by the Applicant for producing 5 MW, instead of using a single six-stage axial turbine designed for a 3000 revolutions per minute rotation, the use of two axial turbines, a high pressure one and a low pressure one, connected to a single generator on the opposite sides thereof by the respective shaft, has been opted for.

The solutions with multiple turbines, such as that described above, involve several technical and economical drawbacks. The plant must be provided with several reduction units for coupling the turbines to the generator (except in the case where the turbines are sized so as to allow a direct coupling solution without the need of a reduction unit), more valves for inflowing vapor into the low pressure turbine with respect to the high pressure intake valves, double bearings and rotary seals, double casing, double shaft, double instrumentation, an insulated duct fluidically connecting the turbines, etc. This results in an increase of the costs for producing, tuning and servicing the plant, as well as technical difficulties for aligning, starting, stopping and operating the plant.

The Applicant proposed an intermediate technical solution between adopting two turbines and making a single multi-stage turbine. The Patent Application WO 2013/108099 describes a turbine specifically designed to operate in an ORC cycle, and comprising centrifugal radial stages followed by axial stages. In a described embodiment, the turbine has a cantilever configuration, i.e. the shaft is supported by bearings arranged on the same side with respect to the supporting disks of the rotor blades.

U.S. Pat. No. 2,145,886 describes a radial turbine having a single supporting disk or double supporting disks, the latter being cantileverly installed. A first disk (reference number 14 in FIG. 1) supports a plurality of stages in the double-rotating portion of the turbine; a second supporting disk (18 ) is coupled to the first disk and supports a plurality of stages in the single-rotating portion of the turbine.

U.S. Pat. No. 2,747,367 describes a gas turbine provided with a multistage axial compressor and a turbine. The shafts are not cantileverly supported. The supporting disks, or the low- and high-pressure compressors and the turbine, are screwed to each other.

For example with reference to FIG. 3, the low-pressure compressor is denoted by the reference number 91. The shaft 88 is supported by three bearings 30, 128, 140 (FIGS. 3 and 5). There are two couplings 101 and 102 (FIG. 3) and they are described (column 3, line 46) as outward extending flanges 101 and 102; the rotor disks 92 are separated by said flanges.

With reference to FIG. 4, the high-pressure compressor is denoted by the reference number 152. The shaft 182 is supported by three bearings 168, 170, 180 (FIGS. 3 and 4). There are two couplings 160 and 162 and they are described (column 4, line 52) as supports (end-bell) of the bearings 160 and 162; the rotor disks 154 (FIG. 4) are separated from the supports of the bearings.

Referring to FIG. 5, the high-pressure turbine 68 comprises a single supporting disk constrained to the shaft 182 of the high pressure compressor, which is in turn supported by three bearings 168, 170 and 180 (FIGS. 3 and 4).

Referring to FIG. 5, the low-pressure turbine 74 comprises two rotor disks; one of them is constrained to the shaft 88 which drives the low-pressure compressor and the other one to the shaft 140. The two disks are also connected to each other, so that the whole assembly is supported by three bearings 30, 128 and 140 (FIGS. 3 and 5).

GB 310037 describes a Ljungstrom turbine provided with two additional axial stages per each radial turbine. The two rotors are cantileverly installed. As described on page 2, line 8, the turbine disk consists of the parts 3, 4 and 5 shown in FIG. 1. The radial stages 8 and 9 are respectively installed on the parts 3 and 4 and, being symmetrical with respect to each other, do not cause the change of the position of the center of gravity of the system. The axial stages 10 and 11 (two on the left and two on the right) are necessarily installed so as to be symmetrically arranged with respect to the central axis of the machine (p. 1 line 87 and the following: "in FIG. 1, A-A designates a plane at right angles to the geometrical axis of rotation 1 of the turbine, about which plane the turbine is symmetrical"). Furthermore, the disks do not annularly extend so as to be able to accommodate a stator in the gap between two adjacent disks.

U.S. Pat. No. 2,430,183 describes a double-rotation radial turbine comprising a counter-rotating reaction turbine (disks 5 and 6 of FIG. 1) and a counter-rotating impulse turbine (disks 6 and 10). The outermost disk 10, actually not having a disk-shape, causes the center of gravity to be shifted away from the bearings of the shafts 3 and 4 thereby causing the moment to increase.

OBJECT AND SUMMARY OF THE INVENTION

It is an object of the present invention to provide a turbine for Rankine ORC cycles, provided with supporting disks of the rotor stages cantileverly arranged with respect to the shaft bearings, which can be provided with a plurality of stages, even more than three, and which is anyway easy to be assembled.

Therefore, a first aspect of the present invention concerns a turbine according to claim 1 designed for an organic Rankine ORC cycle, or, subordinately, for Kalina or water vapor cycles.

In particular, the turbine comprises a shaft supported by at least two bearings and a plurality of axial stages of expansion, defined by arrays of stator blades alternated with arrays or rotor blades.

The rotor blades are sustained by corresponding supporting disks.

Unlike traditional solutions, one of the supporting disks—hereinafter named main supporting disk—is directly coupled to the shaft, in an outer position with respect to the bearings, i.e. in a non-intermediate area among the bearings, and the remaining supporting disks are constrained to the main supporting disk, and one to the other in succession, but not directly to the shaft. In other words, preferably only the main supporting disk extends towards the turbine axis, until it touches the shaft.

The proposed solution allows a cantilevered configuration of the turbine to be maintained, where the arrays of rotor blades are actually supported by the shaft although at an outer area with respect to the bearings, so that it is still possible to have a plurality of stages, even more than three if desired. Therefore, the turbine can be designed so as to expand the working fluid with a high enthalpy jump, similar to that obtainable by the conventional multistage axial turbines, which are not cantilevered, or by two coupled axial turbines, other conditions being unchanged.

As later described in detail, the cantilevered configuration according to the present invention allows to assemble and disassemble the turbine in a rather simple manner, both in the building step and for servicing. Briefly, the supporting disks of the rotor blades can be constrained to each other all at once or in groups, outside of the turbine, to be then inserted "in packs" into the volute before inserting also the shafts and the respective disks.

Advantageously, at least some—if not all—the remaining supporting disks are constrained to the main supporting disk and cantileverly extend on the same side of the bearings that support the shaft. This allows to shift the center of gravity of the rotating portion of the turbine towards the bearings supporting it. As the number of the supporting disks cantileverly mounted on the main disk increases, the center of gravity correspondingly shifts towards the bearing system that supports the shaft.

For example, U.S. Pat. No. 2,145,886 describes a radial, and not axial, turbine in which additional stages do not shift the center of gravity of the turbine at the axial position of the first stage, i.e. towards the bearings. Moreover the second disk, denoted by the number 18, mainly is a second outermost portion of the disc 14 not contributing to the formation of enough space for the stator between two consecutive disks.

U.S. Pat. No. 2,747,367 does not describe a solution in which a main supporting disk and other disks constrained thereto are provided, nor a "cantilevered" assembling solution.

Optionally, other supporting disks are constrained to the main supporting disk and cantileverly extend from the opposite side of the bearings that support the shaft. Clearly, as the number of these supporting disks increases, the center of gravity of the rotary portion of the turbine tends to shift away from the bearings.

Preferably, all the supporting disks except the main one are provided with a large central hole, i.e. they toroidally extend around a central hole; the diameter of the central hole is greater than the outer diameter of the shaft so that an extended volume is defined between each ring and the shaft. This volume, or gap, can be exploited to house the stator parts of the support of a seal and bearings (thereby allowing the turbine-side bearing to be housed in a position close to the center of gravity of the rotor) and to insert the shaft through the disks that have been previously fit on the volute and for maintenances, in order to allow to insert instruments, for example inspection instruments.

Preferably, the supporting disks are bolted one to another and the main supporting disk is constrained to the shaft by means of a coupling selected from: a flange provided with bolts or stud bolts, a Hirth toothing, a conical coupling, a cylindrical coupling with a spline or keyed profile. Preferably, as explained above, during the assembling step the shaft can be inserted through the supporting disks/rings which are in turn already inserted in the turbine volute; the bearings are mounted at a later time for completing the assembly.

In the preferred embodiment the arrays of rotor blades farthest from the main supporting disk on the side of the bearings are the high pressure ones, i.e. where the working fluid expansion starts.

In the preferred embodiment the turbine comprises at least three supporting disks upstream of the main supporting disk and, in case, one or more disks downstream of the latter and corresponding stages of expansion of the working fluid.

In another embodiment of the turbine, the first expansion stage of the working fluid is a radial stage of centripetal or centrifugal type depending on whether the working fluid expands by moving towards the axis of the turbine or away therefrom, respectively. In this situation, the working fluid is diverted in order to expand in the axial stages provided downstream of the first stage. The diversion takes place at the so-called angular blades.

In the preferred embodiment the turbine comprises a stator part, for example an injection volute of the working fluid. The arrays of rotor blades are constrained to the stator part, alternated with the arrays of stator blades. In order to facilitate the turbine assembly, the stator part defines a stepped inner volume, in which the steps are cut so as to form increasing diameters in the expansion direction of the working fluid. The steps of the stator part provide effective abutment and supporting surfaces for the arrays of stator blades which can be easily fixed thereto, even one-by-one.

Preferably, each of the supporting disks comprises at least one flanged portion cantileverly protruding towards the flanged portion of an adjacent supporting disk for a butt coupling. The joined flanges of two adjacent supporting disks together with the volute define the volume in which turbine blade assemblies are confined and through which the working fluid expands. Preferably, one or more though holes are formed through the flanged portion of the disks in order to drain any liquid, such as working fluid in liquid phase or lubricating oil. In order to limit leakages of pressurized working fluid during normal operation, in a structural variation, a shut-off valve can be installed in each of these holes, the valve being configured for:

closing the respective hole while the turbine is operating, i.e. when the shaft is rotating, thereby preventing the vapor of working fluid from passing therethrough, opening the hole when the speed of the turbine is reduced (as it starts or stops), to allow any liquid fluid accumulated in the volume between the flanges and the turbine shaft to be discharged (the condensed working fluid or lubrication oil leaked from the mechanical rotary seals, or even water, if present).

Clearly, for each disk it is possible to provide more valves circumferentially arranged on the flanged portion in order to keep the balance of the disk during rotation.

Preferably, each valve comprises:

an obstructing member, for example a metal ball, which can be inserted into the respective through hole obtained in the flange of the supporting disk, and a biasing elastic member, for example a spring, designed for constantly pushing the obstructing member in a position of open hole. The preload of the elastic member is such that the centrifugal force applied on the obstructing member when the rotor reaches a given speed is higher than the preload of the elastic member, so that the hole is kept closed when the turbine is operating, and open when the turbine is operating at low speed or is totally stopped.

As an alternative, each valve comprises a spherical obstructing member and a respective housing, preferably a pack of leaves held together by screws and provided with an inner cavity. The housing is partially open towards the hole to be intercepted, so that at least part of the obstructing member can protrude from its own housing towards the hole. An elastic supporting member cantileverly supports the housing; for example, the housing is constrained to the elastic supporting member, for example an elastomeric sheet in its turn fastened to the supporting disk near the hole. Following the bending of the elastic member, the obstructing member intercepts the hole thereby closing it, or it is moved away from it so that the latter is kept open.

The Applicant reserves to file a divisional application relating to a shut-off valve similar to the above described one, which can be used on supporting disks in other types of turbine.

Preferably, one or more passages are obtained through the main supporting disk for the discharge of the working fluid. These holes allow the working fluid leaked from labyrinths installed among the rotors and the stator blades to pass through, thereby equalizing the pressure upstream and downstream of the disk itself.

In an embodiment at least the first turbine stage, i.e. the first stage the fluid passes through in the direction of expansion thereof, is centripetal radial or centrifugal radial. Especially in the case in which the radial portion comprises more than one stage, this solution has an even greater number of stages, the axial dimensions of the turbine being equal.

Furthermore, the adoption of one or more centripetal or centrifugal stator arrays of the radial type gives the advantage of facilitating the adoption of variable pitch stators in the very first arrays, since the single blades can rotate about axes parallel to each other (and parallel to the shaft) and which are not otherwise oriented, as in axial arrays. The installation of a stator able to be oriented and working as a valve could be enough to provide this function without the need of a real whole stage.

Preferably, the turbine comprises a volute and the head of the shaft has a diameter shorter than the inner volute diameter, so that the shaft can be inserted and drawn out by sliding it out through the volute.

As regards the turbine seals, preferably one of them is defined by a ring surrounding the shaft and is translatable from a recess obtained in the volute, in order to move into abutment against a corresponding circular band on the shaft head, preferably on the main disk, that in this case will extend up to the rotor axis in order to ensure the fluid seal, or else directly on a supporting disk. This solution is particularly advantageous to insulate the inner environment of the turbine from the outer environment during servicing steps.

BRIEF DESCRIPTION OF THE DRAWINGS

However, further details of the invention will be evident from the following description made with reference to the attached figures, in which:

FIG. 3 is a schematic axially-symmetrical sectional view of a third embodiment of the turbine according to the present invention, in a first configuration;

FIGS. 3A and 3B are enlargements of a detail of FIG. 3, in two different configurations;

DETAILED DESCRIPTION OF THE INVENTION

Figure 1:
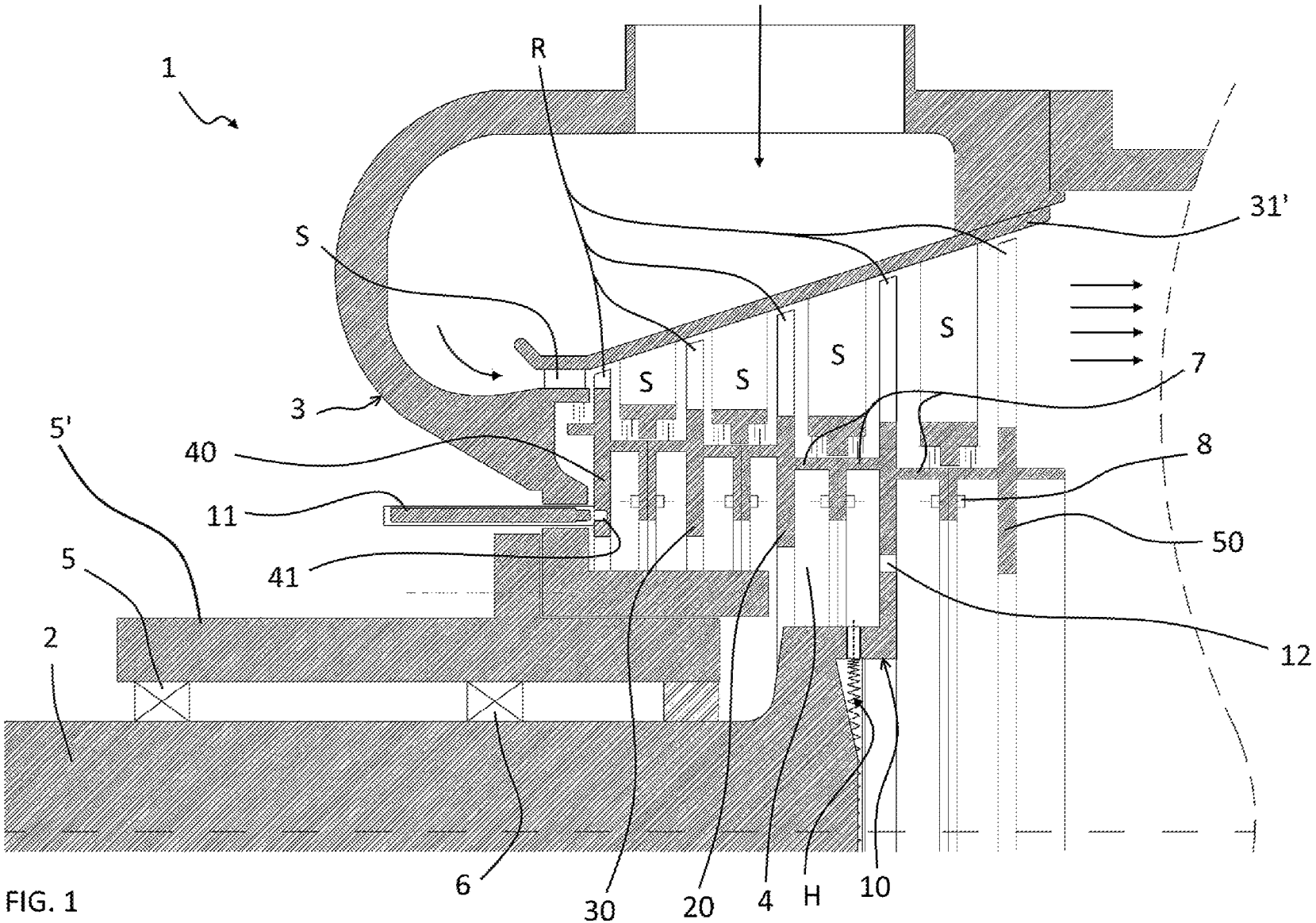
FIG. 1 is a schematic axially-symmetrical sectional view of a first embodiment of the turbine according to the present invention.

FIG. 1 shows a first embodiment of a turbine 1 according to the present invention, comprising a shaft 2, a volute 3 for injecting the working fluid to be expanded and discharging the expanded working fluid, and a plurality of stages of expansion being in turn defined by arrays of stator blades S alternated with arrays of rotor blades R.

Observing FIG. 1, the stages farthest to the left are the high-pressure ones and the stages farthest to the right are the low-pressure ones.

Supporting disks numbered as 10, 20, 30, 40, 50 sustain the rotor blades. Bearings 5 and 6 support the shaft 2.

For the purposes of the following description, volute 3 generally means the stationary supporting members of the turbine 1. As the field technician will comprise, the volute 3 can be formed in its turn by several elements.

It should be noted that, in the attached figures, labyrinths are only schematically shown. Actually, in order to constrain the parts that will be described—often having different diameters—labyrinths defined in their turn by surfaces having different diameters have to be provided.

The stator blades are fastened to the volute 3 and therefore are stationary; the rotor blades have to rotate integrally with the shaft 2. This is achieved by a particular arrangement of the supporting disks 10-50 that allows to obtain a cantilevered configuration of the turbine 1.

Only one of the supporting disks, called main supporting disk 10 for the sake of simplicity, is directly coupled to the shaft 2—and in the case shown in figure by means of a toothing H of the Hirth type—while the remaining supporting disks 20-50 are coupled to the main disk 10 but not directly to the shaft 2, i.e. they do not touch it.

In more detail, as can be seen in the sectional view of FIG. 1, actually the supporting disks 40, 30 and 20 arranged upstream of the main disk 10 and the disk 50 arranged downstream of the disk 10 are rings which have limited radial extension, that is to say that they do not extend up to the vicinity of the shaft 2.

A volume or gap 4 is left among the rings 40, 30, 20, 10 and the shaft 2. The gap 4 is exploited for housing the stator parts of the support of the seal 5' and the bearings 5 and 6, thereby allowing the turbine to be designed with the center of gravity towards the bearings, thus more to the left than the main supporting disk 10, and for inserting the turbine shaft 2 through the disks 20, 30 and 40 previously fitted in the volute 3 and for allowing to insert tools for servicing.

In practice, each of the supporting disks 10-50 has a flanged portion 7 cantileverly extending in an axial direction for achieving a butt coupling with the flanged portion 7 of an adjacent disk. In the example shown in figure the flanged portions 7 are bolted to one another by the bolts 8, so as to form a pack of supporting disks 10-50 integrally rotating with the shaft 2.

As evident, the bolts 8 are circumferentially arranged along the flanged portions 7. In the section between two bolts, the flange portion can be obtained in order to lighten the respective disk and reduce the effect of load reduction on the bolt due to the presence of an intense tangential tensile stress which causes a necking of the disk, in relation to the value of Poisson's modulus of the material.

The proposed solution provides the advantage of allowing the arrangement of more stages of expansion upstream of the main supporting disk 10, so that these stages are just cantileverly supported by the main disk 10 and not directly supported by the shaft. The disks 20-40 and 50 are not directly constrained to the shaft 2; on the contrary, the only one coupling provided is with the supporting disk 10 at the head of the shaft 2, anyway outside of the bearings 5 and 6.

The operations of assembling the turbine 1, which can be carried out in two ways, are therefore remarkably simplified.

According to a first way, the shaft 2 is inserted through the disks 10-50 previously placed in the volute 3, i.e. the shaft 2 can be the last inserted therein with the respective bearings 5 and 6 (from left to right looking at the figures).

According to a second way, the shaft 2 and the disks 10-50 are pre-assembled outside the volute 3, to form a pack to be then inserted into the volute 3 all at once (from right to left looking at the figures). Subsequently, the mechanical seal and the bearings 5 and 6 are then mounted with a method of sliding these elements on the shaft itself from the end opposite to the main disk 10.

Although the stages upstream of the disk 10 have cantilevered configuration, the center of gravity of the assembly of the rotating elements is still closer to the bearing 6 or even between the bearings 5 and 6, thanks to the fact that some parts of the volute 3 may be housed 4 in the gap left by the ring shape of the rotor disks 20, 30 and 40. This is an important feature in order to decrease the flexibility of the shaft-rotor assembly, thereby allowing to achieve a 'rigid' operation of the system, i.e. with the first flexural critical speed high enough to be greater than the rotating speed of the turbine, by a wide margin. Clearly, if the designer provides multiple disks downstream of the main supporting disk 10 (to the right of the disk 10 in FIG. 1), the center of gravity tends to be shifted away from the area of the bearings 5, 6 (the moment increases, the system becomes more flexible, the first flexural critical speed decreases). Total number of disks, respective geometry and mass properties being equal, as the number of disks cantileverly mounted towards the system of bearings 5 and 6 increases, the position of the center of gravity of the rotating masses moves closer to the system of bearing 5 and 6, thereby causing the increase of the flexural eigenfrequency of the rotor/bearing system. The change of the position of the center of gravity causes also the value of the moment of inertia relative to the barycentric axes orthogonal to the rotation axis to change.

The value of this element affects the eigenfrequency and must be taken into account according to the calculation methods known in the art.

Furthermore, in order to minimize the cantilevered mass and, therefore, maximize the value of the first critical flexural speed of the shaft-supporting disk assembly, the designer may also decide to use lighter materials compared to iron alloys, such as aluminum or titanium, to manufacture the blades and/or supporting disks.

Figure 2:
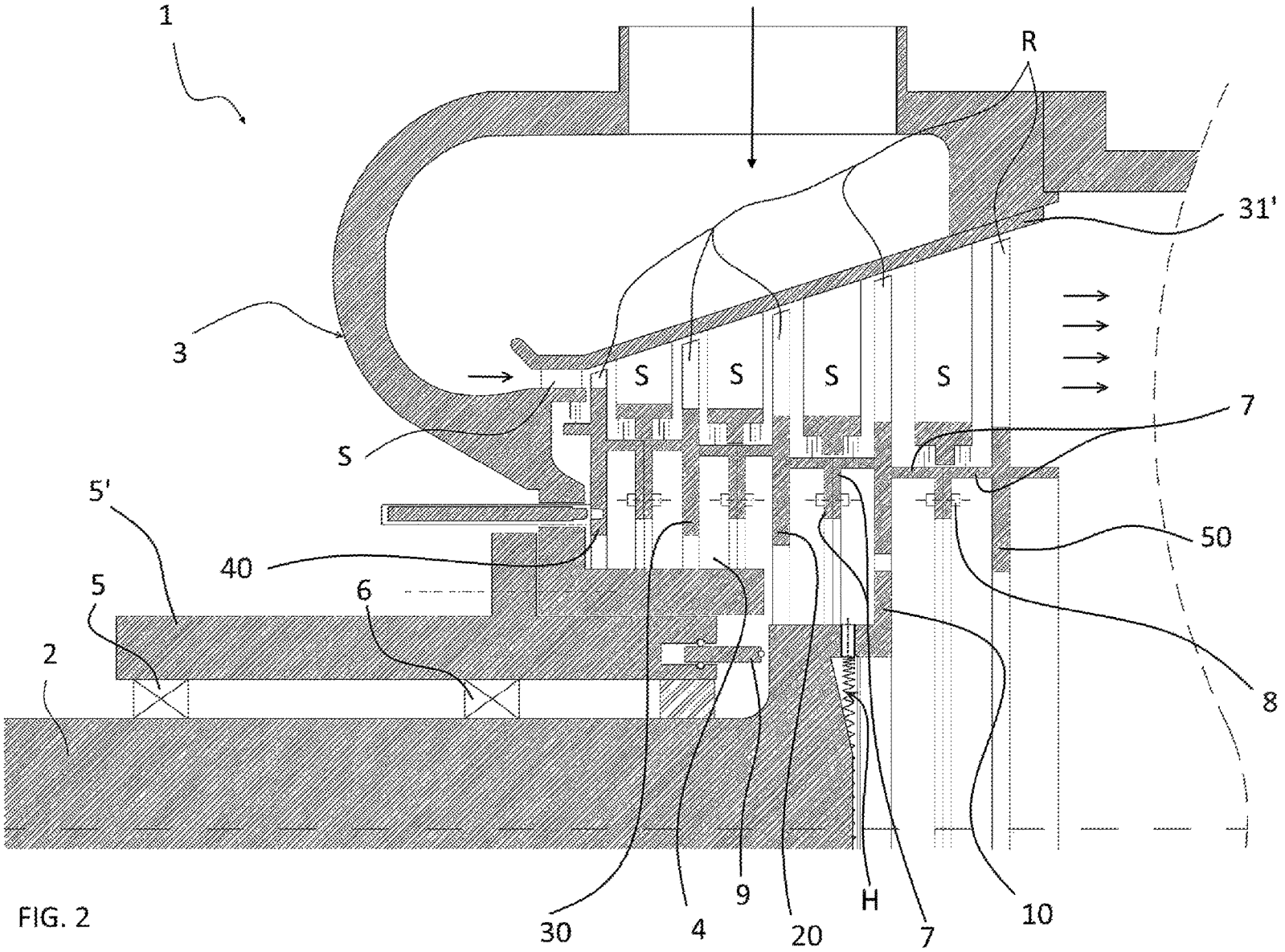
FIG. 2 is a schematic axially-symmetrical sectional view of a second embodiment of the turbine according to the present invention.

If it was necessary to carry out maintenance requiring the mechanical seal to be disassembled, when the turbine is stopped, it is possible to operate a sealing ring 9 shown in FIG. 2 by causing its translation from a corresponding seat in the volute 3 so as to move into abutment against the head of the shaft 2. The temporary seal allows to keep the inner environment of the turbine 1 isolated from the external environment during the extraordinary maintenance and, therefore, to prevent air from entering the turbine from outside or vice versa the working fluid from leaking outside, depending on the pressure inside the stopped turbine.

Figure 6:
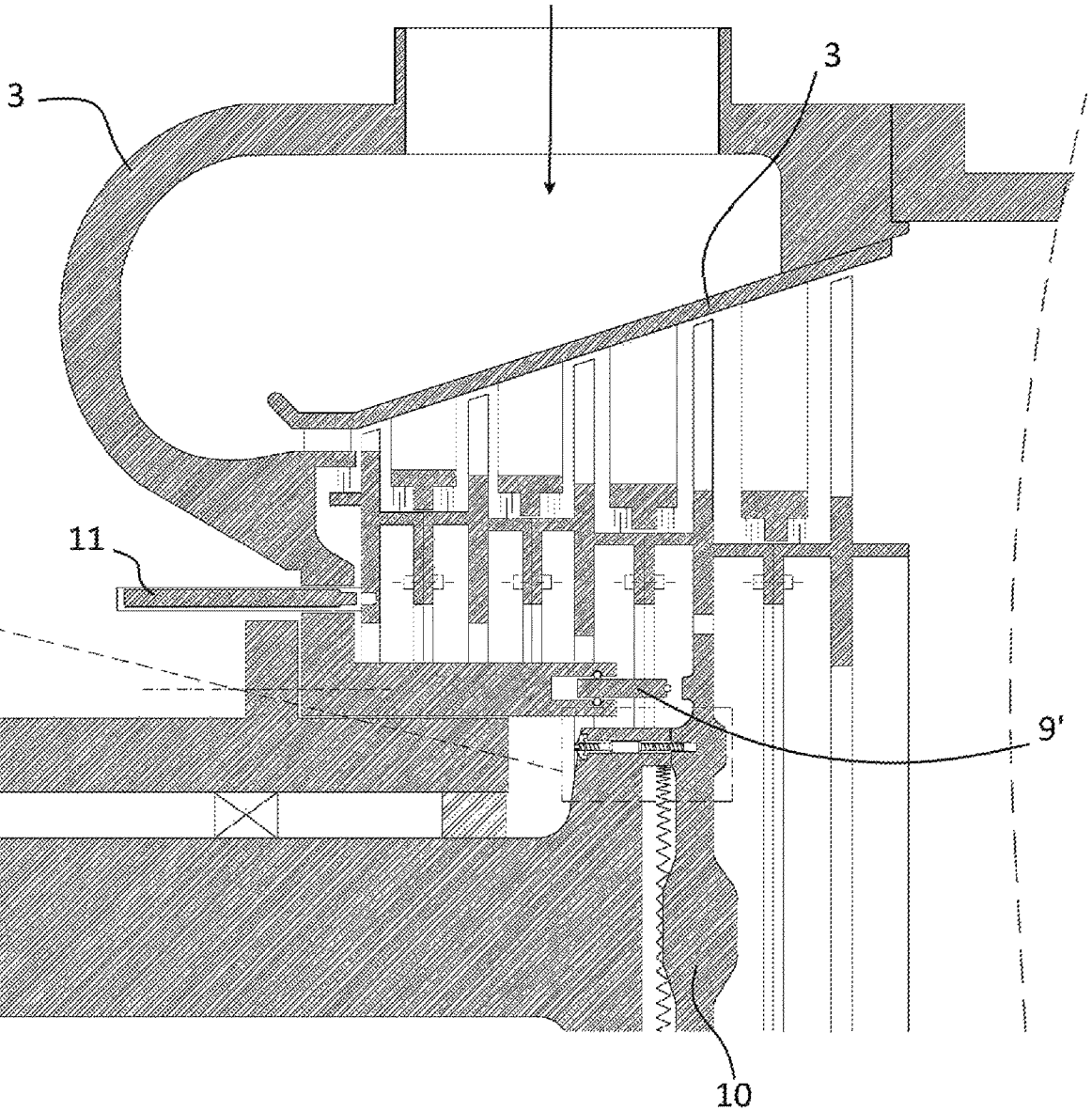
FIG. 6 is a schematic axially-symmetrical sectional view of a fifth embodiment of the turbine according to the present invention.
Figure 7:
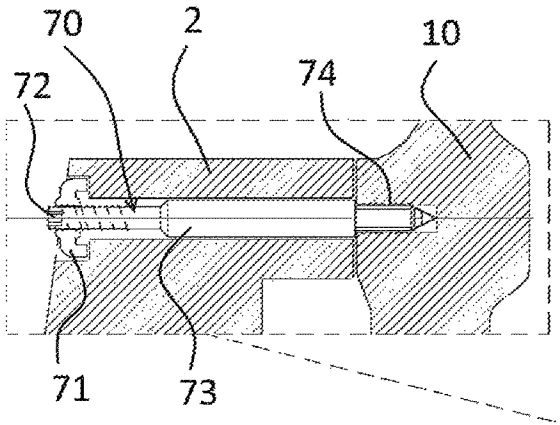
FIG. 7 is an enlarged view of a detail of FIG. 6.

As an alternative, there can be a ring seal translating on a larger diameter, the seal, when in the advanced position, abutting against one of the supporting disks of the rotor (preferably the main disk). In this case, the shaft 2 can be released from the Hirth toothing without losing the seal. In a further possible configuration, there can be two the sealing rings 9, one abutting against the shaft 2 and the other abutting against the main supporting disk 10, respectively. In this case, the first one is used as a frequently used ring, to be used when the turbine currently stops, and will be preferably provided with elastomer sealing gaskets, whereas the second will be rarely used when unforeseen events occur, requiring the shaft 2 and the bearing/housing sleeve assembly 5, 5', 6 to be disassembled. Thanks to the double ring it is possible, among other things, to change the elastomer gasket of the innermost seal. The shaft 2 can be connected to the main disk having the Hirth toothing, by means of bolts (depicted with the respective axis of symmetry) or through tie rods 70, as shown in FIGS. 6 and 7, to be preferably hydraulically loaded. The tie rods 70 can be accessed from the side of the bearings 5 and 6 and each comprises a ring nut 71, a hexagonal socket 72, a centering cylinder 73 and a threaded body 74 which meshes a corresponding hole of the main supporting disk 10.

This operation is facilitated by the use of a fastening system that fastens by means of tie rods 11 to be translated in order to lock the supporting disks 10-50 and prevent them from rotating. The tie rods 11 can be inserted into the threaded holes 41 formed in the supporting disk 40. Preferably, each tie rod 11 has its own seal to prevent the working fluid from leaking outside the turbine through the seat of the tie rod 11 itself.

Once inserted in the corresponding holes 41, the tie rods 11 are fixed to the volute 3 so as to keep locked the supporting disks 10-50 with respect to the volute 3, thus allowing the ring 9 to abut against the head of the shaft 2 or the main disk 10 thereby obtaining the seal during servicing steps.

Considering again the assembly of the turbine 1 and with reference to the embodiment shown in FIG. 2, it is possible to form a pack of components, as now described. Pre-assembly is carried out outside the volute 3, according to the following order:

a. the first stator S to the far left;

b. the rotor R on the supporting disk 40;

c. the second stator S;

d. the second rotor R on the supporting disk 30, and by connecting the disks 30 and 40 by means of bolts 8 on the opposite flanged surfaces 7;

e. the third stator S;

f. the third rotor R on the supporting disk 20, and by connecting the disks 20 and 30 by means of bolts 8 on the opposite flanged surfaces 7;

g. the fourth stator S;

h. the fourth rotor R on the supporting disk 10, and by connecting the disks 10 and 20 by means of bolts 8 on the opposite flanged surfaces 7;

i. the fifth stator S;

j. the fifth rotor R on the supporting disk 50, and by connecting the disks 10 and 50 by means of bolts 8 on the opposite flanged surfaces 7, and so on if there are a greater number of stages.

The stators S are fastened to the portion 31' of the volute 3 by screws, or by means of other known techniques, for example by engaging the blades in special grooves obtained into the volute 3.

This pre-assembled pack of components is then inserted into the volute 3. At this point, the shaft 2 is inserted through the disks 20-50 themselves and along the provided path, then the bearings 5 and 6 are positioned and kept in position by spacers (not shown).

In the main supporting disk 10 there are one or more through holes 12 to allow balancing pressures between the portions upstream and downstream of the disk 10 itself.

FIG. 3 shows a third embodiment of the turbine 1, which differs from that shown in FIG. 2 because it is provided with shut-off valves 13 positioned on the flanges 7 of the disks 10-50. More in detail, the flanges 7 of the discs 10-50 are perforated, i.e. a plurality of through holes 14 is circumferentially formed thereon. Each of the through holes 14 is intercepted by a valve 13.

The valves 13 comprise an obstructing element 15 to obstruct the respective hole 14; in the example shown in the figures it is a metal ball 15. A spring 16 pushes the obstructing element 15 away from the hole 14 in order to open the passage. The elastic force of the spring 16 is countered by the centrifugal force applied on the ball 15 when the disks 10-50 are rotating. The preload of the spring 16 is specifically selected so that, when the turbine 1 is operating at a speed equal to or higher than a given intermediate speed, the holes 14 are kept closed.

Instead, the shut-off valves 13 automatically open the holes 14 when the turbine rotates at a speed lower than said intermediate speed, to allow the discharge of the working fluid in liquid phase possibly retained in the gap 4, or the discharge of lubricating oil possibly leaked from the rotating seal of the turbine.

Figure 4:
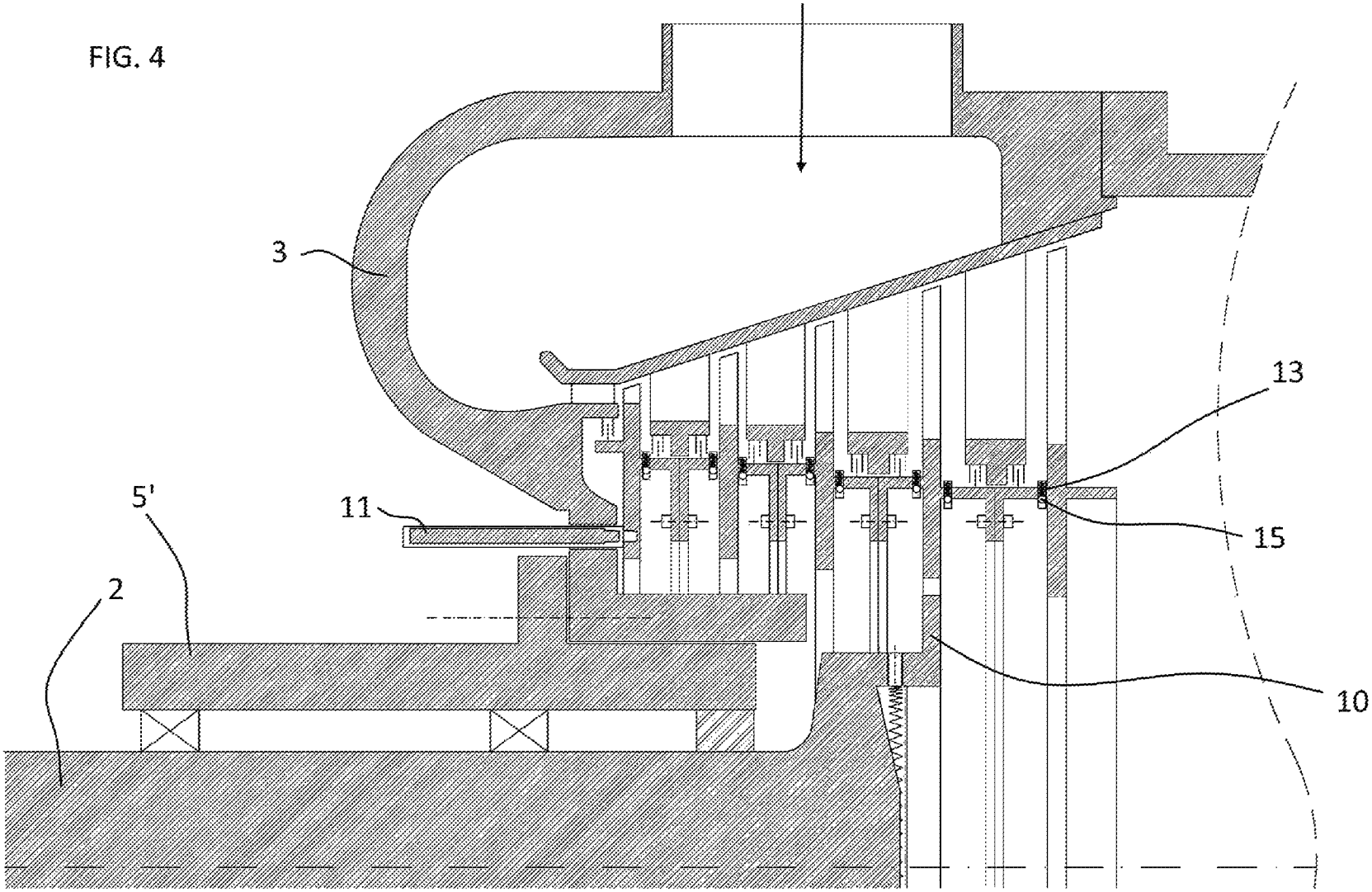
FIG. 4 is a schematic axially-symmetrical sectional view of the third embodiment of the turbine according to the present invention, in a second configuration.

In particular, in FIGS. 3 and 3B the turbine is stopped, the valves 13 are open (the tie rod 11 is engaged in the disk 40 and locks it). In FIGS. 3A and 4 the valves 13 are closed (the turbine is rotating at a speed higher than the intermediate speed or at the nominal speed).

FIG. 4 shows the same turbine of FIG. 3, but with the valves 13 closed.

Figure 5:
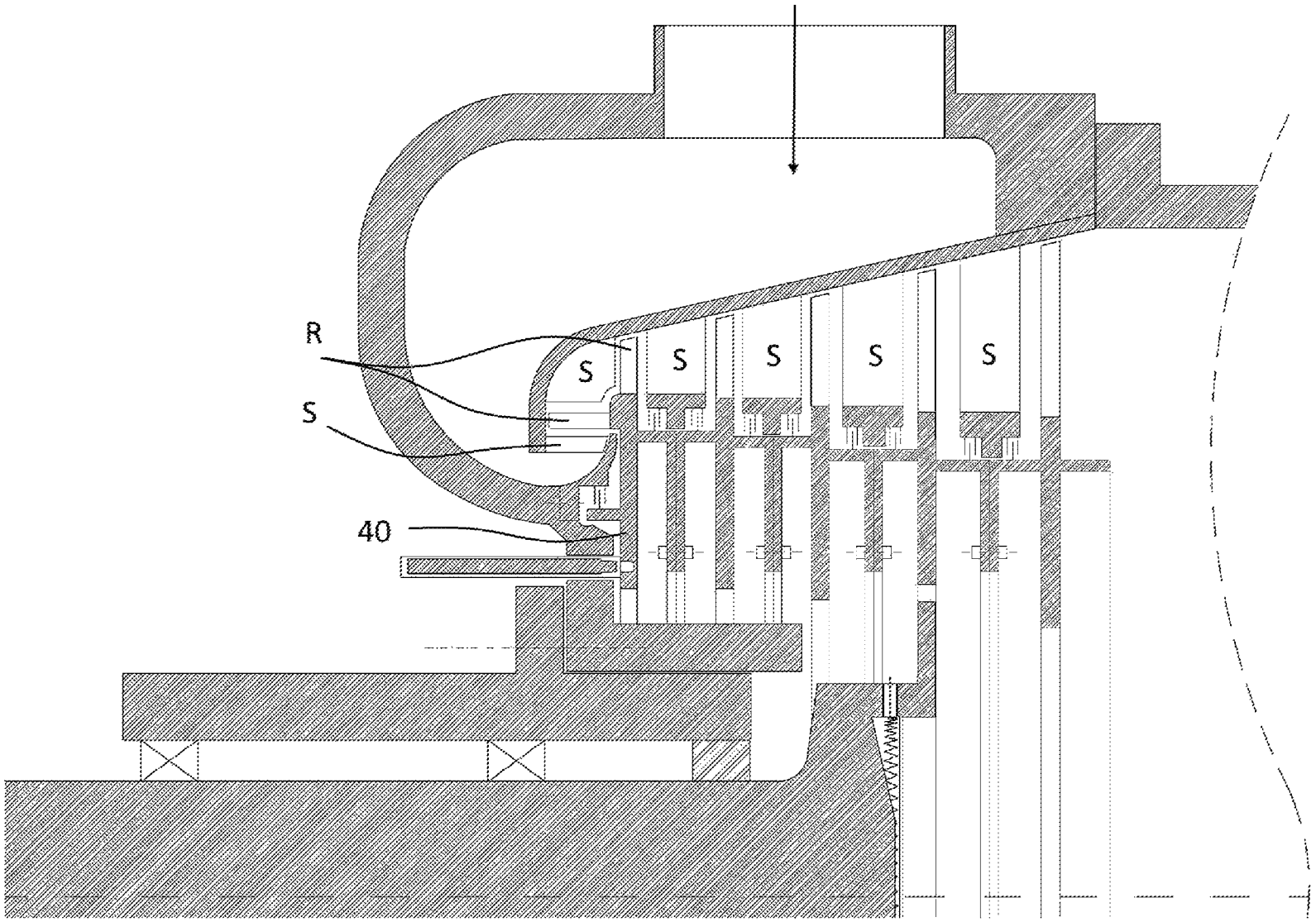
FIG. 5 is a schematic axially-symmetrical sectional view of a fourth embodiment of the turbine according to the present invention, provided with a first radial centrifugal stage of expansion.

FIG. 5 shows a fourth embodiment of the turbine 1 which is different from the previous ones because the first stage of expansion is centrifugal radial and the second stage comprises an array of angular stator blades which divert the flow in the axial direction. The remaining stages are axial as in previously described embodiments.

In particular, by adding at least one radial stator blade assembly it is possible to arrange a system for varying or intercepting the flow, for example a system of variable pitch blades, thereby lowering the costs with respect to the axial stator blade system.

FIG. 6 shows an embodiment with a solid shaft 2. The shaft 2 is coupled to the main supporting disk 10 by the Hirth toothing and a plurality of tie rods 70, which are shown as enlarged in FIG. 7. The turbine comprises a sealing ring 9' translating from the volute 3 and having a greater diameter with respect to the ring 9 shown in FIG. 2. The ring 9' moves in abutment against the main supporting disk 10 in order to obtain the seal.

Although not shown in the attached figures, in an embodiment of the turbine there can be both the translating seals 9 and 9' to be used alternatively, or in combination, for servicing.

Figure 8:
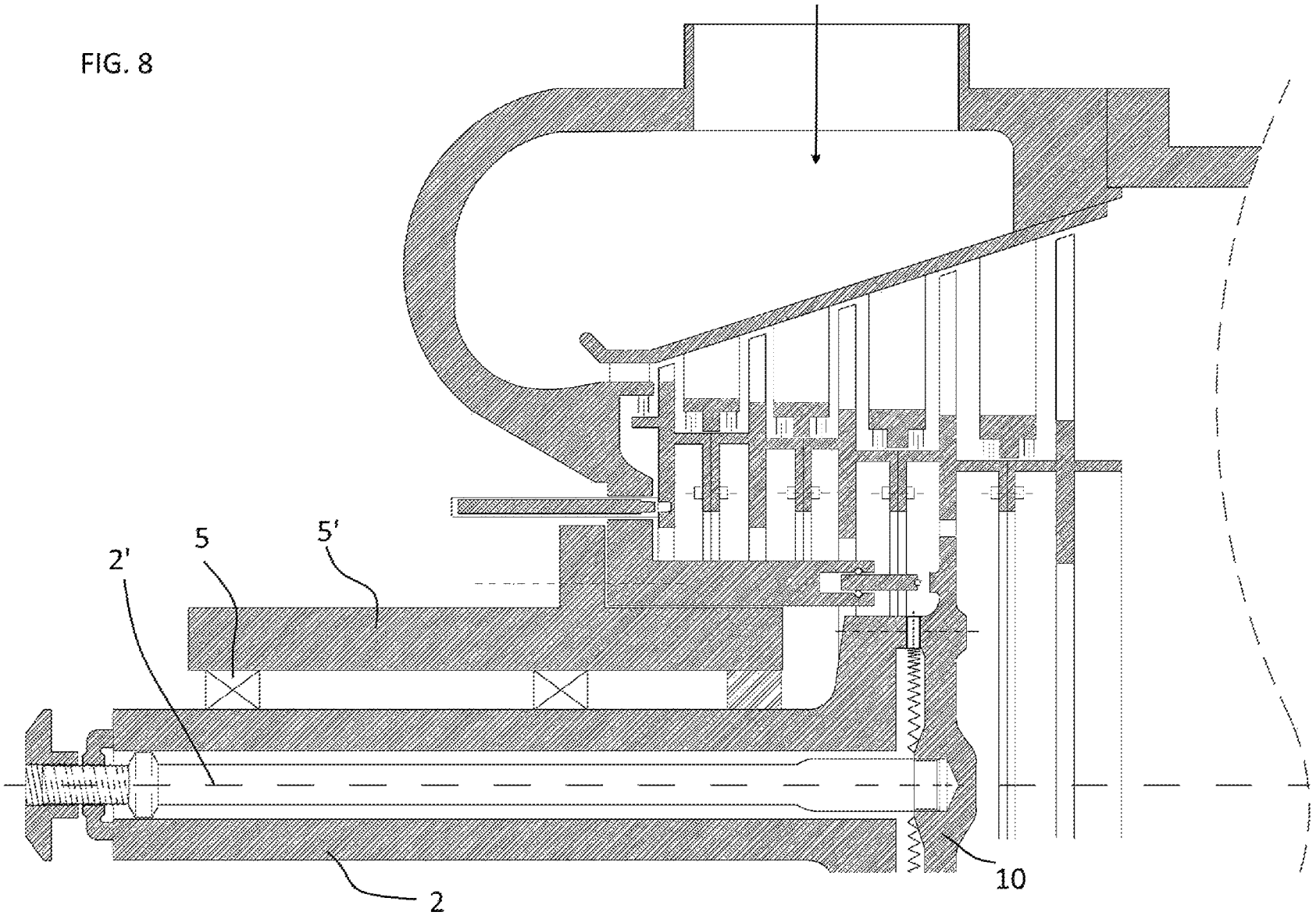
FIG. 8 is a schematic axially-symmetrical sectional view of a sixth embodiment of the turbine according to the present invention.

FIG. 8 shows an embodiment with a hollow shaft 2. A tie rod 2 is arranged therein and is screwed to the main supporting disk 10. It is an alternative solution for locking the Hirth toothing.

Figure 9:
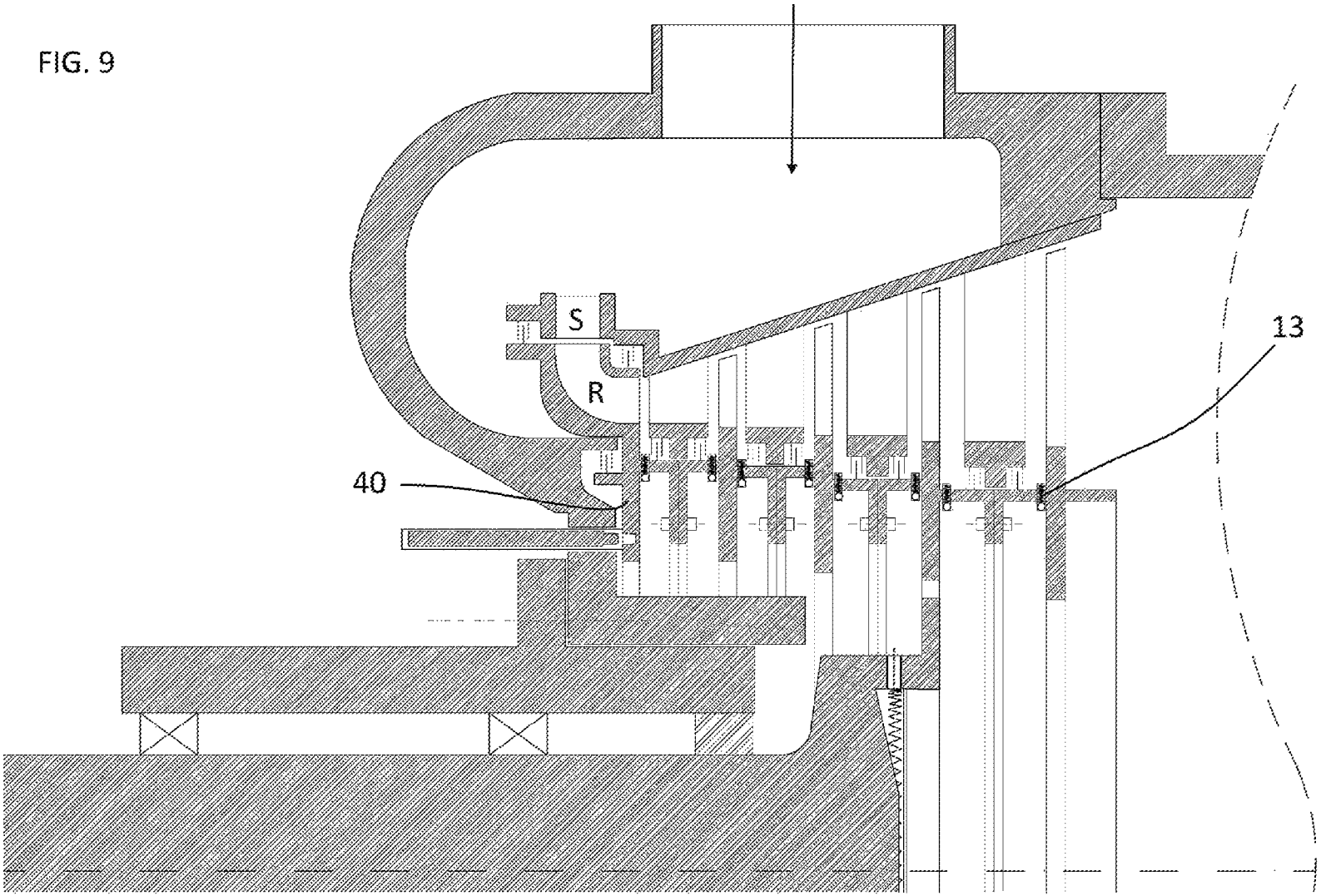
FIG. 9 is a schematic axially-symmetrical sectional view of a seventh embodiment of the turbine according to the present invention, provided with a first radial centripetal stage of expansion.

FIG. 9 shows yet another embodiment in which the first stage of expansion is centripetal radial. In this case, the angular blades are rotor blades supported by the disk 40.

Figure 10:
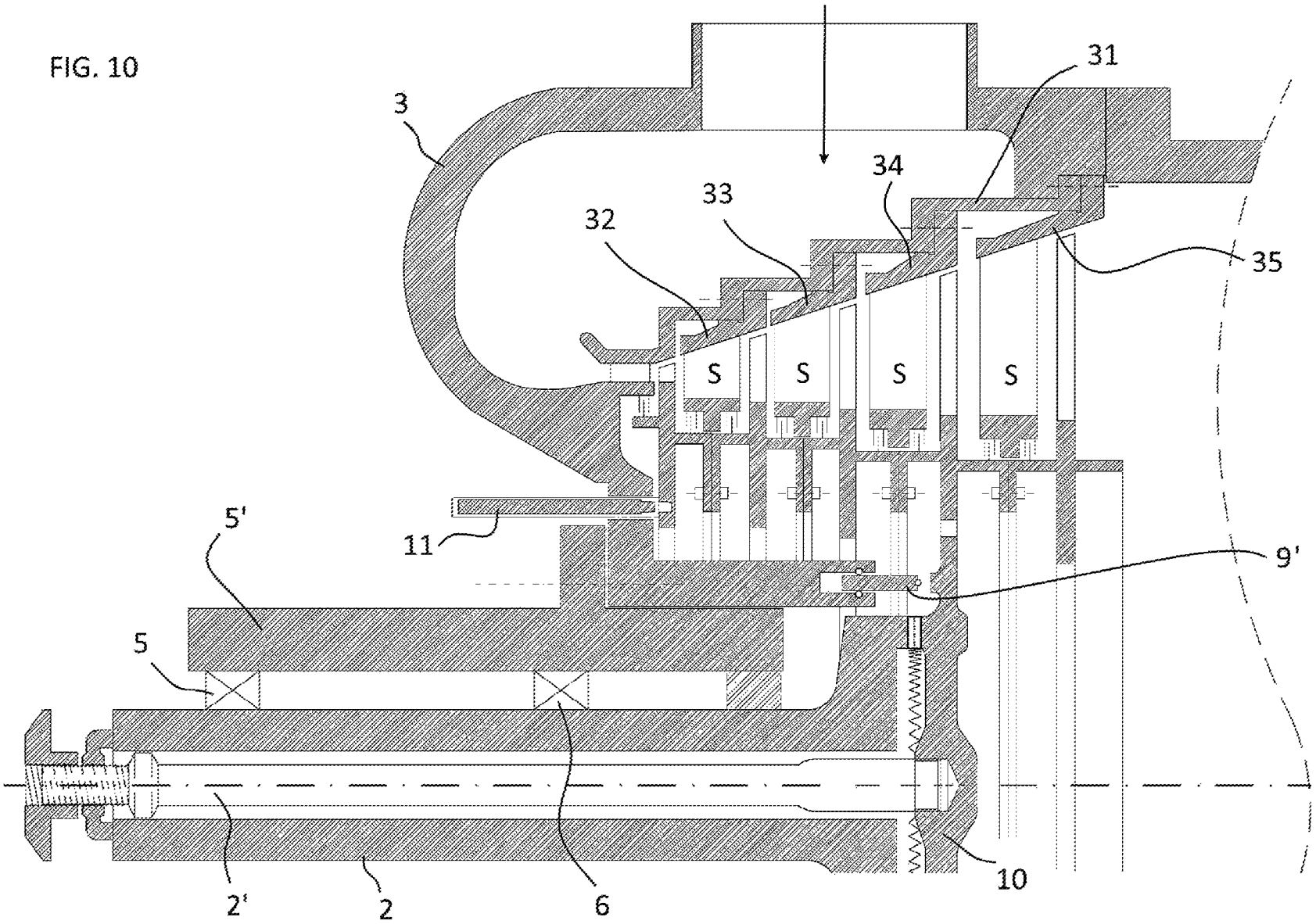
FIG. 10 is a schematic axially-symmetrical sectional view of an eighth embodiment of the turbine according to the present invention, provided with a stepped volute.

FIG. 10 shows yet another embodiment in which the volute 3 comprises a grooved, i.e. stepped, inner ring 31. The arrays of stator blades S are each fastened to a corresponding coupling ring 32-35 to be coupled to the grooved inner ring 31.

In practice, the coupling rings 32-35 can be successively screwed one by one, in succession, to the grooved inner ring 31 at a step thereof. The screwing is carried out outside of the turbine and, lastly, the ring 31 with the stator arrays S, the supporting disks 10-50 and the rotor R is inserted into the volute 3 and fastened thereto.

The pre-assembled pack made up of the ring 31 with the stator arrays S, the supporting disks 10-50 and the rotor arrays R can be simply screwed to the volute 3.

Figure 11:
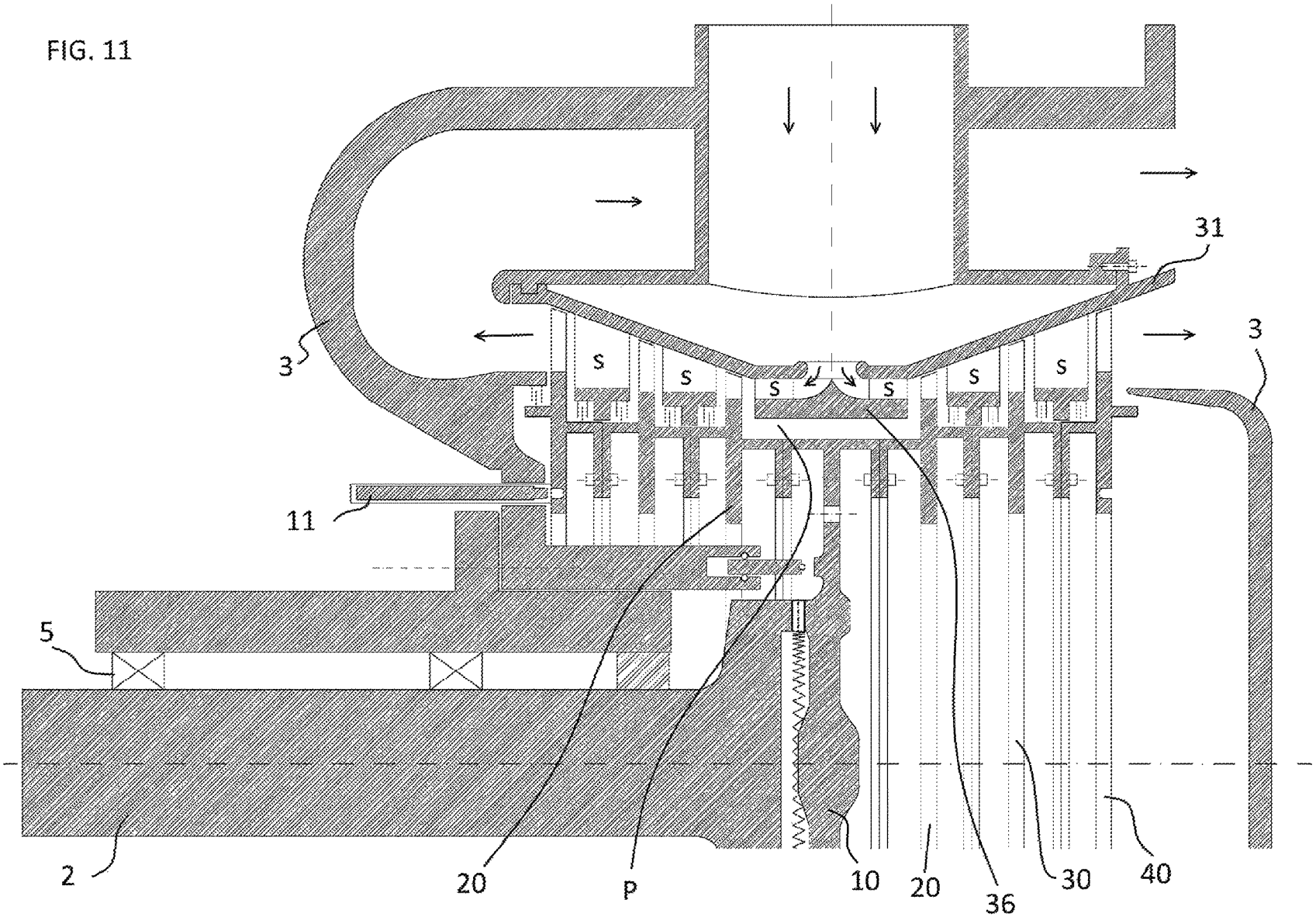
FIG. 11 is a schematic axially-symmetrical sectional view of a ninth embodiment of the turbine according to the present invention, of the dual-flow type.

FIG. 11 shows a further embodiment of the turbine 1, characterized by being of the dual-flow type. The working fluid inlet is preferably at the median plane of the main supporting disk 10. The reference number 36 denotes a ring to be coupled to the inner ring 31 of the volute 3. The ring 31 is fastened from right to left, and then bolted, to the volute 3. The coupling ring 36 includes two symmetrical split stator arrays S, which divert the flow of working fluid on opposite sides. The remaining stator S and rotor R arrays are alternated in a symmetrical specular way with respect to the main supporting disk 10. A passage P is provided among the ring 36 and the supporting disks 10 and 20 in order to prevent pressure unbalances. This allows the center of gravity of the rotor part of the turbine to be exactly on the main supporting disk 10.

Figure 12:
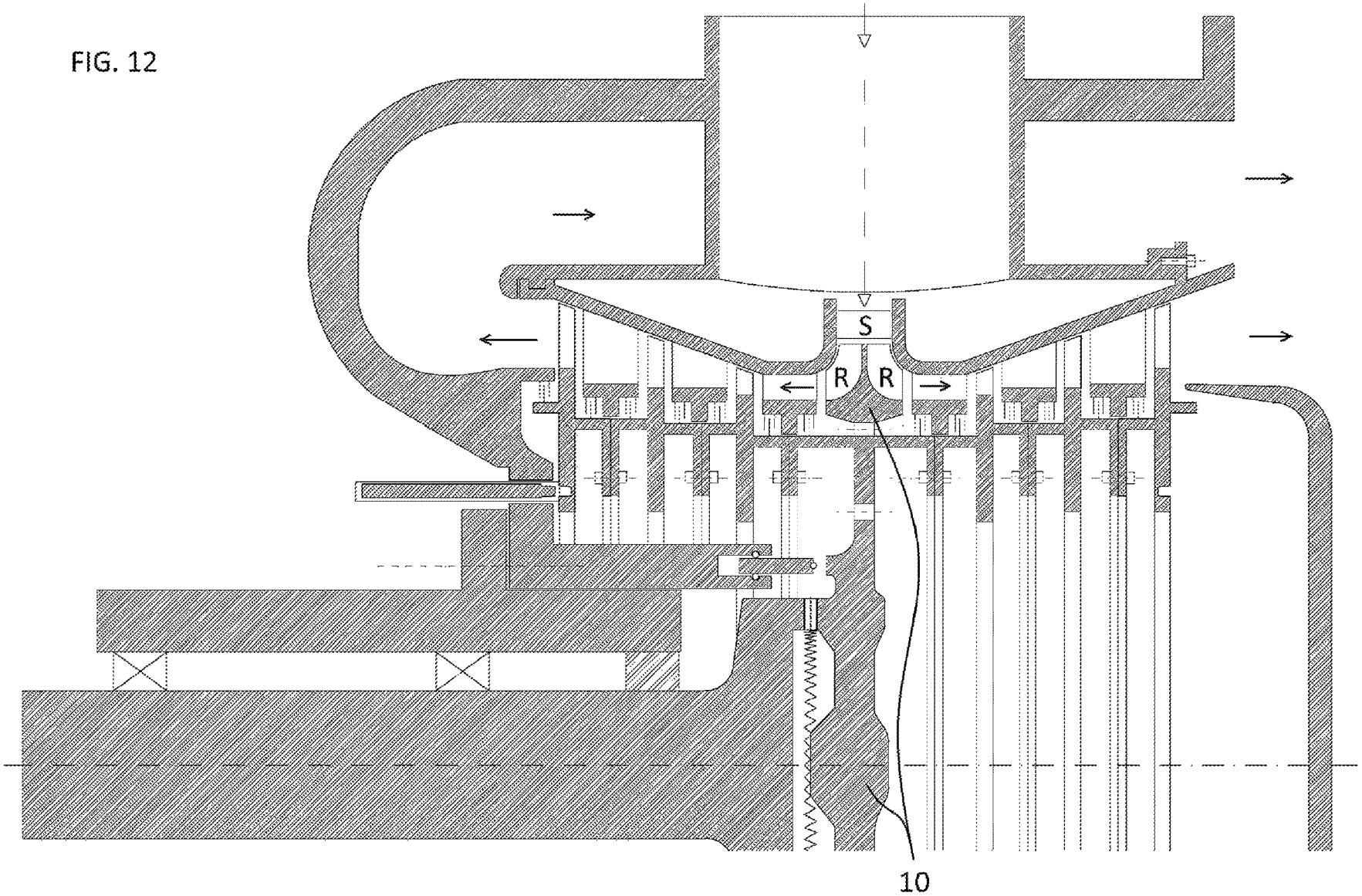
FIG. 12 is a schematic axially-symmetrical sectional view of a tenth embodiment of the turbine according to the present invention, of the dual-flow type.

FIG. 12 shows a tenth embodiment of the turbine, similar to the previous one, but different in that following the first stator array S where the working fluid enters, two specular rotor arrays R are provided, which axially divert the flow, on opposite sides. These rotor arrays R are both supported by the main supporting disk 10.

The assembly diagram of the turbines shown in FIGS. 11 and 12 is similar to that described for the other embodiments.

Figure 14:
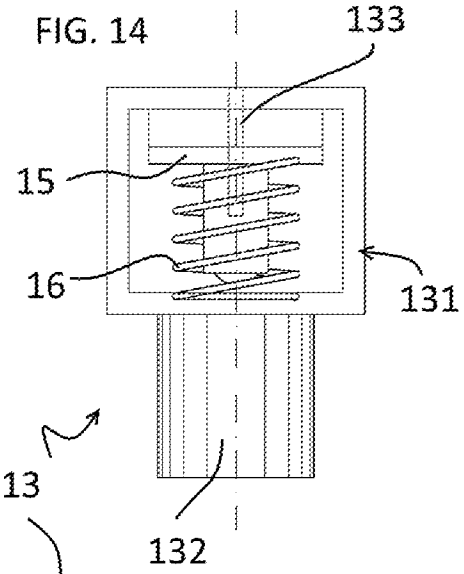
FIG. 14 is a schematic section of a second embodiment of a valve used in the turbine according to the present invention.
Figure 15:
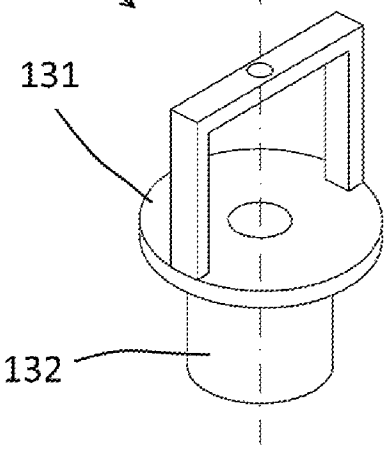
FIG. 15 is a perspective view of a member of the valve shown in FIG. 14.

FIGS. 14-15 show a possible configuration of the shut-off valves 13 provided with a body 131 on which an obstructing element 15 is mounted, for example a cylinder having a spherical end able to radially slide on the supporting pin 133 and countered by a spring 16. The obstructing element 15 is radially movable to intercept or clear the hole 14 obtained in the flanged portion 7 of the respective supporting disk 10-50. The body 131 has a threaded portion 132 to be screwed into the hole 14.

Figure 13:
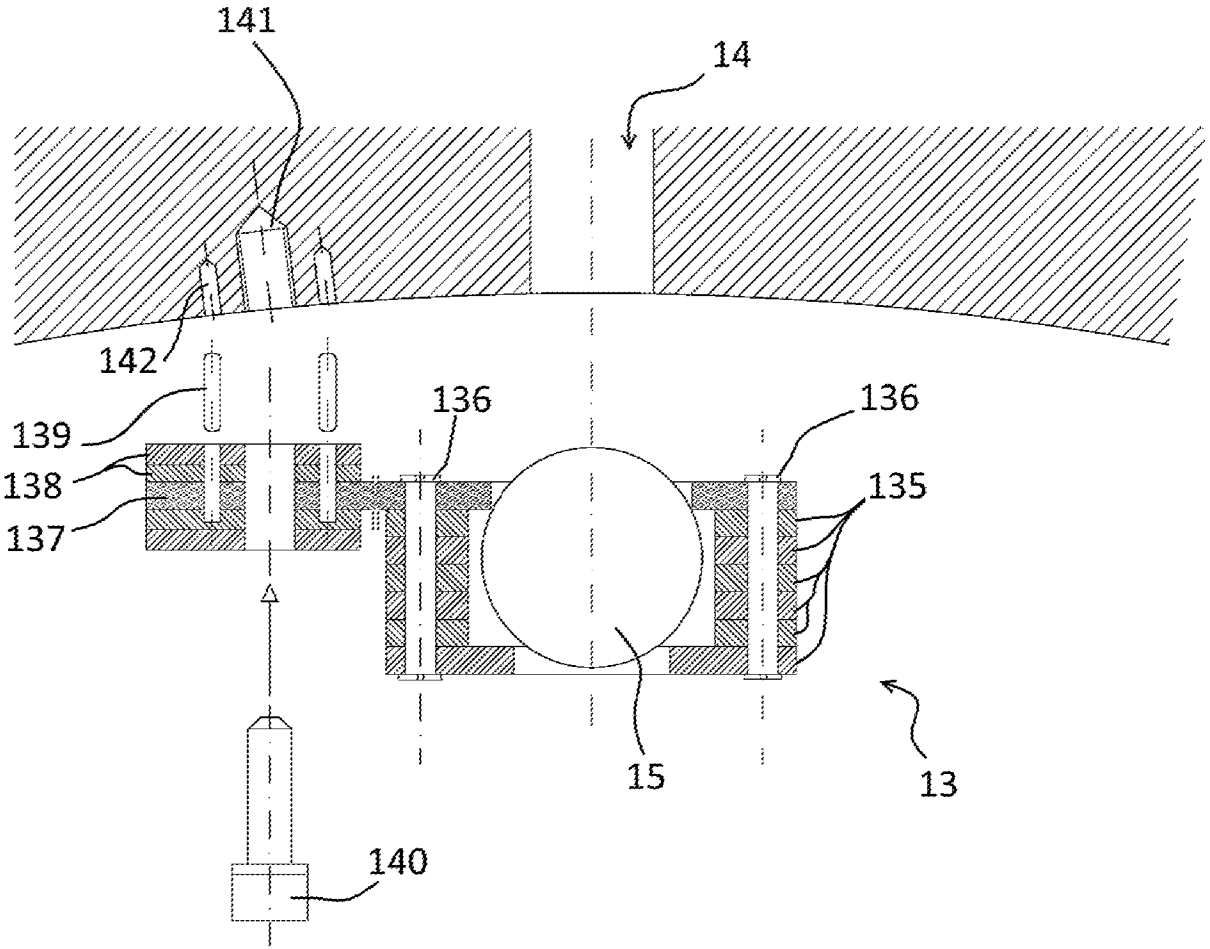
FIG. 13 is a schematic section of a first embodiment of a valve used in the turbine according to the present invention.

A further embodiment of the shut-off valve 13 is shown in FIG. 13. An obstructing ball 15 is installed inside a pack of leaves 135 held together by riveted pins 136 or screws. The ball 15 can freely translate having a play inside the space created by the pack of leaves 135 thereby being able to fit when the centrifugal force pushes it against the hole 14. The leaf 137 elastically supports the leaf assembly 135 and the ball 15. The leaves 138 act as spacers. The pins 139 have centering function of the fastening screw 140 in the respective holes 142 (for the pins) and 141 for the screw 140.

FIG. 13 shows the valve not mounted on the respective disk. When the turbine is rotating at a lower speed with respect to the (above defined) intermediate one, the leaf spring 137 and the spacers 138 keep the ball 15 away from the hole 14. When the speed is higher, the leaf spring 137 bends and the obstructing ball 15 abuts against the hole 14 thereby obstructing it. The designer can modify the elasticity of the spring 137 and 16 together with the mass of the movable system, in order to determine the value of the intermediate speed at which the valve itself is operated.

The invention claimed is:

1. A turbine (1) of an organic Ranking cycle (ORC), or Kalina cycle or water vapor cycle, comprising a shaft (2) supported by at least two bearings (5, 6), a plurality of arrays of rotor blades (R) and corresponding supporting disks (10-50), and a plurality of arrays of stator blades (S), wherein a main supporting disk (10) of said supporting disks (10-50), is directly coupled to the shaft (2) in an outer position with respect to the bearings (5, 6), and the remaining supporting disks (20-50) are constrained to the main supporting disk (10), and to one another in succession, but not directly to the shaft (2), wherein at least some (20-40) of the remaining supporting disks are constrained to the main supporting disk (10), by cantileverly extending from the same part of the bearings (5, 6) that support the shaft (2), so that the center of gravity of the rotor part of the turbine (1) is more shifted towards the bearings (5, 6) with respect to the center of gravity position of the main supporting disk (10) alone, or at least coincident therewith.

2. The turbine (1) according to claim 1, wherein at least some (50) of the remaining supporting disks are constrained to the main supporting disk (10), by cantileverly extending in a direction opposite to the bearings (5, 6) that support the shaft (2), so that a number of turbine stages (1) is increased.

3. The turbine (1) according to claim 1, wherein the supporting disks (20-50), except the main disk (10), are provided with a central hole, thereby being configured as rings, so that between each ring and the shaft (2) a gap (4) is defined and extended as necessary to house stator components, comprising seals and bearings (5, 6) and respective housing sleeves (5').

4. The turbine (1) according to claim 1, wherein the supporting disks (10-50) are bolted one to another and the main supporting disk (10) is constrained to the shaft by means of a coupling selected from: a flange, bolts or stud bolts, Hirth toothing (H), a conical coupling, a splined or keyed profile, one or more cylindrical couplings, to be assembled in pressurized-oil conditions.

5. The turbine (1) according to claim 1, wherein the arrays of rotor blades (R) farthest from the main supporting disk (10) at the side of the bearings (5, 6) are high pressure blades.

6. The turbine (1) according to claim 1, wherein a series, or pack, of supporting disks (10-50) can be pre-assembled outside of the turbine (1) in order to be installed into the turbine all at once.

7. The turbine (1) according to claim 1, further comprising a volute (3), to which the arrays of stator blades (S) are constrained as alternated with the arrays of rotor blades (R), wherein the stator part defines a solid of revolution (31) provided with a stepped inner surface and each array of stator blades (S) is fastened to at least one of said steps by rings (32-35) and, in this case, the supporting disks (10-50) can be inserted in the stator part also one by one.

8. The turbine (1) according to claim 1, wherein each of the supporting disks comprises at least one flanged portion (7) cantileverly protruding towards the flanged portion (7) of an adjacent supporting disk for a butt coupling, and comprising at least one through-hole (14) passing through said flanged portion (7), and a shut-off valve (13) of the at least one through-hole (14), the shut-off valve being configured for:

closing the at least one through-hole (14) during the operation of the turbine (1) and therefore avoiding passage of working fluid, opening the at least one through-hole (14) when the turbine (1) rotates slowly or is stopped, in order to allow the discharging of working fluid that might be built up in the volume (4) adjacent the flanges (7), in liquid phase, or the discharging of lubricating oil that might be leaked through the seals of the turbine (1).

9. The turbine (1) according to claim 8, wherein each valve (13) comprises:

an obstructing member (15) to obstruct the at least one through hole (14) obtained in the flange (7) of the respective supporting disk (10-50), and a biasing elastic member (16, 137) configured to push the obstructing member (15) in an open through hole (14) position, and wherein the preload of the elastic member (16, 137) is such that the centrifugal force applied on the obstructing member (15) when the turbine is operating is higher than the preload of the elastic member (16), so that the at least one through-hole (14) is still closed when the turbine (1) is operating at a nominal speed, and open when the turbine (1) is stopped or operating at low speed.

10. The turbine (1) according to claim 8, wherein each valve (13) comprises:

a spherical obstructing member (15);

a housing for the obstructing member (15), comprising a pack of leaves (135) that defines an inner cavity, which is partially open towards the at least one through-hole (14) so that at least a part of the obstructing member (15) can protrude from the housing itself towards the at least one through-hole (14);

an elastic supporting member (137) to support the housing, wherein the housing is constrained to the elastic supporting member (137)fastened to the supporting disk near the at least one through-hole (14), and wherein following the bending of the elastic member (137), the obstructing member (15) intercepts the at least one through-hole (14) or is moved away from it so that the latter is kept open.

11. The turbine (1) according to claim 1, wherein, through the main supporting disk (10), one or more passages (12) are obtained for balancing the pressure upstream and downstream of the same main disk (10) and said holes are positioned on a diameter larger than a sealing ring (9'), if present.

12. The turbine (1) according to claim 1, wherein a first turbine stage, in a working fluid expansion direction, is centripetal radial or centrifugal radial.

13. The turbine (1) according to claim 12, comprising at least three supporting disks (20-40) upstream of the main supporting disk (10) and one or more disks (50) downstream from the main supporting disk (10), and corresponding stages of expansion of the working fluid.

14. The turbine (1) according to claim 1, wherein the turbine comprises a volute (3) and a head of the shaft has a diameter shorter than an inner volute diameter, so that the shaft can be drawn out by sliding it out through the volute (3).

15. The turbine(1) according to claim 1, comprising at least one seal (9, 9') defined by a ring surrounding the shaft (2) and is translatable from a recess obtained in a volute (3) or other stationary member (5'), in order to move into abutment against a corresponding circular seat obtained on the shaft end, the seat being designed to be coupled to the main supporting disk (10) or against the main supporting disk (10).

16. The turbine (1) according to claim 1, wherein the turbine is a dual-flow type, comprising a plurality of expansion stages at both sides of one of the supporting disks (10-50), and wherein a working fluid starts expanding at said supporting disk through a radial inlet and is axially diverted in two flows at opposite parts of said supporting disk.

17. The turbine (1) according to claim 16, wherein the fluid starts expanding at the main supporting disk (10) through a radial inlet and is axially diverted in two flows, at opposite parts of said main supporting disk (10).

18. The turbine (1) according to claim 16, comprising an annular cavity (P) fluidically communicating an outlet of the first stator (S), upstream of the supporting disk where the fluid starts expanding, with an outlet of the first stator (S) downstream of the supporting disk itself.

19. The turbine (1) according to claim 16, wherein in a first expansion stage (R) the fluid passes through is of centripetal radial type, with a dual- flow rotor (10) connected to the supporting disk.

20. ORC Rankine cycle plant, or Kalina cycle plant or water vapor cycle plant, comprising a turbine (1) according to claim 1.

21. A turbine (1) of an organic Ranking cycle (ORC), or Kalina cycle or water vapor cycle, comprising a shaft (2) supported by at least two bearings (5, 6), a plurality of arrays of rotor blades (R) and corresponding supporting disks (10-50), and a plurality of arrays of stator blades (S), wherein a main supporting disk (10) of said supporting disks (10-50), is directly coupled to the shaft (2) in an outer position with respect to the bearings (5, 6), and the remaining supporting disks (20-50) are constrained to the main supporting disk (10), and to one another in succession, but not directly to the shaft (2), wherein at least some (20-40) of the remaining supporting disks are constrained to the main supporting disk (10), by cantileverly extending from the same part of the bearings (5, 6) that support the shaft (2), so that the center of gravity of the rotor part of the turbine (1) is more shifted towards the bearings (5, 6) with respect the center of gravity position of the main supporting disk (10) alone.

* * * * *